United States Patent [19]

Neeley et al.

[11] 4,289,459

[45] Sep. 15, 1981

[54] PROPORTIONING PUMP

[76] Inventors: William E. Neeley, 6152 Cardeno Dr., La Jolla, Calif. 92037; Terrell F. Moose, 6119 Horton Dr., La Mesa, Calif. 92041

[21] Appl. No.: 65,921

[22] Filed: Aug. 13, 1979

[51] Int. Cl.[3] ..... F04B 43/12; F04B 45/08

[52] U.S. Cl. ..... 417/475; 417/477

[58] Field of Search ..... 417/477, 475, 476, 474; 418/45, 225

[56] References Cited

U.S. PATENT DOCUMENTS

| | | | |
|---|---|---|---|
| 2,935,028 | 5/1960 | Farrari et al. | 417/475 |
| 3,386,382 | 6/1968 | Schuette et al. | 417/477 X |
| 3,433,170 | 3/1969 | Malbec | 417/477 X |
| 3,507,585 | 4/1970 | Mercer | 418/45 X |
| 3,723,030 | 3/1973 | Gelfand | 417/477 X |
| 3,732,042 | 5/1973 | Buchholz | 417/477 |
| 3,740,173 | 6/1973 | Natelson | 417/477 X |
| 3,990,444 | 11/1976 | Vial | 417/477 X |
| 4,205,948 | 6/1980 | Jones | 417/477 |

FOREIGN PATENT DOCUMENTS

| | | | |
|---|---|---|---|
| 2141352 | 3/1973 | Fed. Rep. of Germany | 417/474 |
| 2525744 | 12/1976 | Fed. Rep. of Germany | 418/45 |
| 1331167 | 5/1963 | France | 417/477 |

*Primary Examiner*—Carlton R. Croyle
*Assistant Examiner*—Edward Look
*Attorney, Agent, or Firm*—Charles C. Logan, II

[57] ABSTRACT

A proportioning pump for automatic fluid analysis apparatus comprising a base having an open chamber formed in its top, a drive shaft supported in the open chamber, and a platen member that closes the top of the open chamber. A pair of roller cage assemblies each have primary bores in their end plates allowing them to be mounted on the drive shaft. The end plates are pinned to the drive shaft so that they rotate as one. Spaced outwardly a predetermined radius from the longitudinal axis of the primary bores are a plurality of secondary bores whose longitudinal axes describe circles in the laterally spaced end plates. Roller rods are journaled in the secondary bores. The outer perimeter of each of the roller rods describes an arc of a predetermined radius from the axis of the primary bore when the roller cage assembly is rotated about its longitudinal axis. The platen member has a bottom pressure surface having a predetermined concave transverse curvature which is positioned with respect to the roller cage assembly such that the spacing between the arc described by the outer surface of the roller rods and the pressure surface gradually decreases from a predetermined maximum to a predetermined minimum and then gradually increases back to a predetermined maximum. A plurality of fluid flow tubes pass in a direction transverse to the axis of the pump and are captured between the top of the roller cage assemblies and the bottom of the platen member.

10 Claims, 6 Drawing Figures

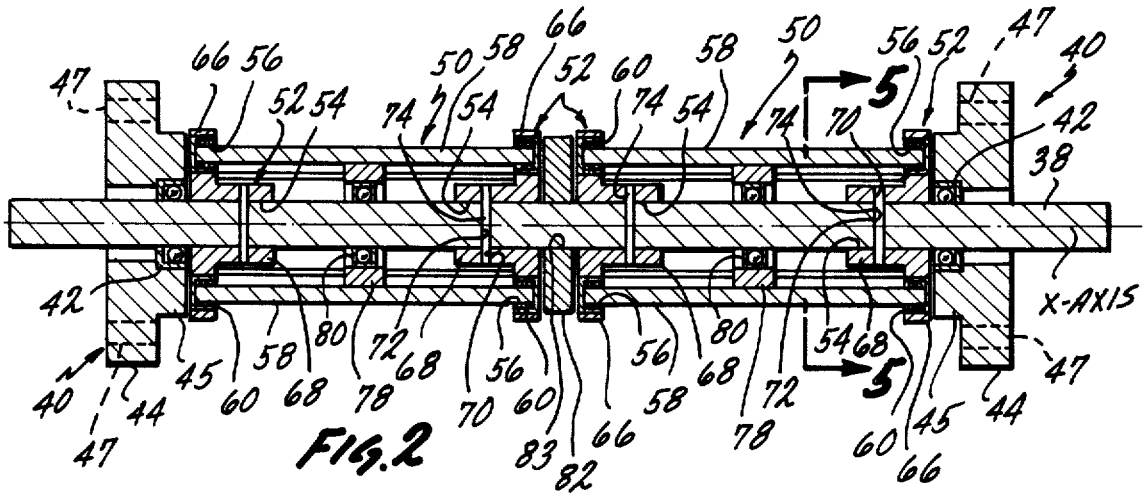
FIG. 2
FIG. 3
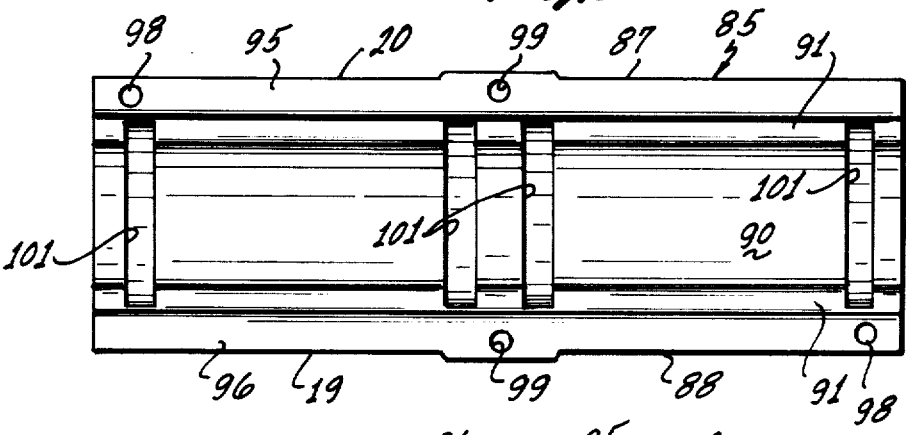
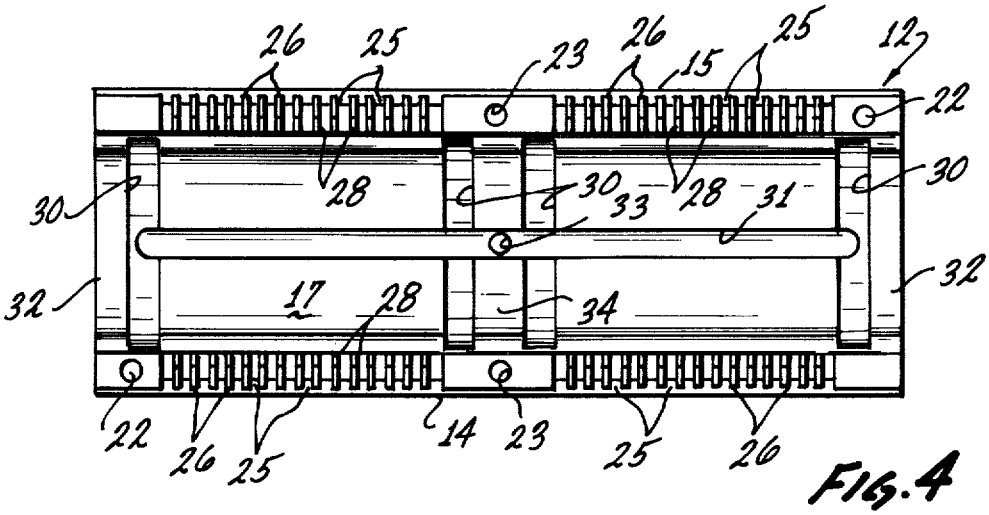
FIG. 4

PROPORTIONING PUMP

Another type of prior art proportioning pump for automatic fluid analysis apparatus is illustrated in U.S. Pat. No. 2,935,028. Briefly described, the pump comprises a series of compressing rollers whose ends are connected to sprocket chains which move the rollers longitudinally of the flexibly resilient pump tubes. During this movement, the pump tubes are compressed along their length by the rollers against a platen for the pumping operation.

It is an object of the invention to provide a novel proportioning pump that is easy to manufacture and assemble.

It is also an object of the invention to provide a novel proportioning pump that can operate at least 32 flexible fluid flow tubes passing therethrough.

It is also an object of the invention to provide a novel proportioning pump that can deliver an even flow of fluid through the flexible tubes even though traveling at low speed.

It is a further object of the invention to provide a novel proportioning pump that is capable of pumping liquid samples along the flexible tubes with a minimal amount of pulsation.

It is an additional object of the invention to provide a novel proportioning pump that is capable of long life and requiring minimal maintenance.

SUMMARY OF THE INVENTION

The proportioning pump for automatic fluid analysis apparatus has a base having an open chamber formed in its top by a bottom wall portion and at least two laterally spaced upstanding walls. A drive shaft is mounted in the open chamber and it has mounting plates adjacent its opposite ends that function as end walls for the open chamber of the base. A platen member closes the top of the open chamber.

A pair of laterally positioned roller cage assemblies are mounted on the drive shaft. Each of the dollar cage assemblies has a pair of laterally spaced and aligned end plates each having a primary bore through which passes the drive shaft. Spaced a predetermined radius from the longitudinal axis of the primary bores are a plurality of secondary bores whose longitudinal axes describe circles in the laterally spaced end plates. Roller rods are journaled in the secondary bores. The roller cage assemblies are pinned to the drive shaft so that they rotate together as one. The outer perimeter of each of the roller rods describes an arc of a predetermined radius from the axis of the primary bore when the roller cage assembly is rotated about its longitudinal axis.

The platen member has a pressure surface on its underside having a predetermined concave transverse curvature which is positioned with respect to the roller cage assembly such that the spacing between the arc described by the outer surface of the roller rods and the pressure surface gradually decreases from a predetermined maximum to a predetermined minimum and then gradually increases back to a predetermined maximum. A plurality of flexible fluid flow tubes pass transversely through the pump between the platen pressure surface and the roller rods. These flexible fluid flow tubes enter and leave the pump on its opposite lateral sides through grooves formed in the base where the platen member and the base mate.

The flexible flow tubes have a predetermined diameter and a predetermined wall thickness. The predetermined diameter of the flow tubes would be substantially the same as the predetermined maximum spacing between the platen pressure surface and the roller rods. The fluid flow tube would also have a predetermined wall thickness and the predetermined minimum spacing between the platen pressure surface and the roller rods would be less than twice the wall thickness of the fluid flow tubes. It is thus to be understood that at the predetermined minimum spacing, the material of the fluid flow tubes would be not only compressed to the point where all flow would be stopped therethrough, but even further compressed to less than twice the wall thickness of the fluid flow tubes.

In operation, fluid is flowing into the flexible fluid flow tubes and is being transported through the pump by the action of the roller rods successively compressing the flow tube from its maximum diameter to a predetermined diameter. The flow of the fluid through the tube during this operation results in a smooth flow having a minimal amount of pulsation in the fluid as it exits the pump.

DESCRIPTION OF THE DRAWINGS

FIG. 2 is a side elevation view of the interior structure of the proportioning pump;

FIG. 3 is a plan view of the bottom of the platen member;

FIG. 4 is a top plan view of the base of the proportioning pump;

DESCRIPTION OF THE PREFERRED EMBODIMENT

Figure 1:
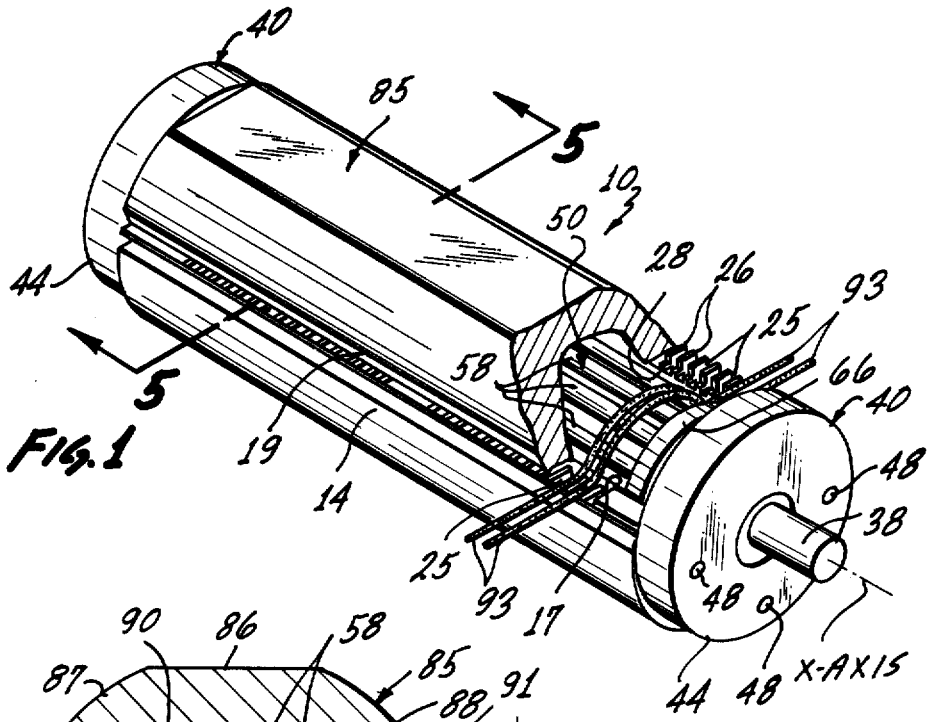
FIG. 1 is a perspective view of the novel proportioning pump for automatic fluid analysis apparatus.

The novel proportioning pump for automatic fluid analysis apparatus will be described by referring to the drawings. The proportioning pump is generally designated numeral 10. It has a base 12 having a bottom wall portion 13 and laterally spaced upstanding walls 14 and 15 that form an open chamber in the top of the base. The hollow chamber has a concave curved interior surface 17.

The top of upstanding sidewalls 14 and 15 form mating surfaces 19 and 20 respectively. Aligning pins 22 and threaded bores 23 are located on the horizontal mating surfaces. Formed along the top of the upstanding side walls 14 and 15 are fluid flow tube grooves 25 having upstanding walls 26. The interior portion of upstanding walls 26 have a relieved area 28. A plurality of roller cage assembly end plate recesses 30 are formed on the curved interior surface 17. At each end of the base a hub support surface 32 is formed on the curved interior surface of the base. Near the center of the interior of the base is formed an intermediate mounting plate support surface 34. A drain groove 31 is also formed in the bottom of the interior surface 17 and it communicates with a drain outlet 33 to remove any liquid that leaks from the fluid flow tubes.

Figure 5:
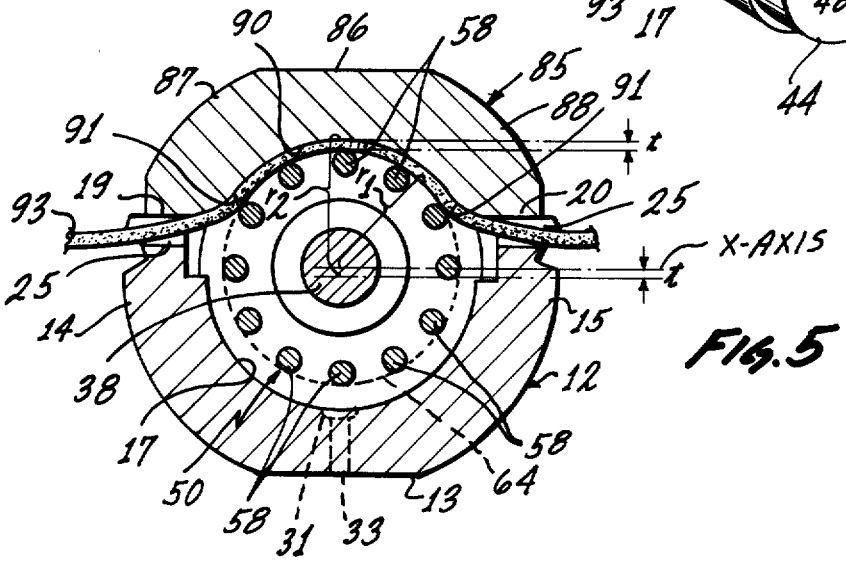
FIG. 5 is a cross sectional view taken along lines 5—5 of FIG. 1.

The structure that is received within the interior of the pump is best illustrated in FIGS. 2 and 5. A drive shaft 38 having a longitudinal x-axis is supported at its opposite ends by end mounting plates 40. Shaft 38 is journaled in the end mounting plates 40 by bearing assemblies 42. End mounting plates 40 also have a disc portion 44 and a hub portion 45. A plurality of bores 47 are formed in disc portion 44 and screws 48 pass through bores 47 and into threaded bores (not shown) in the end walls of base 12. End mounting plates 40 thus form end walls for the open chamber formed in the top of the base.

Drive shaft 38 is supported in the open chamber and it has a pair of roller cage assemblies 50 mounted thereon. Each of the roller cage assemblies has a pair of laterally spaced and aligned roller cage end plates 52 each of which has a primary bore 54 throughwhich passes the drive shaft 38. Spaced a predetermined radius from the longitudinal x-axis of the primary bores are a plurality of secondary bores 56 whose longitudinal axes describe circles in laterally spaced roller cage end plates 52. Roller rods 58 are journaled within bearings 60 in the secondary bores. The outer perimeter of each of the roller rods describes an arc 64 having a predetermined radius from the x-axis of the primary bore when the roller cage assembly 50 is rotated about its longitudinal axis. Each of the roller cage end plates 52 has a disc portion 66 and a boss portion 68. Aligned transverse bores 70 and 72 pass through the boss portion 68 and shaft 38 respectively. A set screw or sleeve pin 74 passes through these aligned transverse bores so that the roller cage assemblies 50 rotate with the drive shaft 38 as a unit when it is rotated. Each of the roller cage assemblies 50 has an idler pressure wheel 78 journaled in bearing assembly 80 on shaft 38 within the interior of the roller cage assembly. The outer lateral surface of the idler pressure wheel 78 is in substantial surface contact with the interior lateral surface of the roller rods 58. Positioned between the roller cage assemblies 50 on drive shaft 38 is an intermediate mounting plate 82 having a bore 83. Drive shaft 38 freely rotates in bore 83.

The open hollow chamber of the base 12 is closed by platen 85. It has a central portion 86 from which extend downwardly extending leg portions 87 and 88. The bottom surface of platen 85 is a curved platen pressure surface 90. Beveled surfaces 91 eliminate the abruptness of the angle that flexible tubes 93 make as they enter the space between curved platen pressure surface 90 and the outer perimeter of roller rods 58.

The bottom surface of platen 85 is illustrated in FIG. 3. At the bottom of leg portions 87 and 88 are found horizontal mating surfaces 95 and 96 respectively. In these horizontal mating surfaces are found aligning pin bores 98 and threaded bores 99. Also found upon the bottom of platen 85 are roller cage end plate recesses 101.

The dimensional relationship between arc 64 and the curved platen pressure surface 90 that has proven most workable is set up by the following process. First the diameter of the desired fluid flow tubes is determined. This dimension is then generally set as the maximum spacing between the outer surface of roller rods 58 and curved platen surface 90. Next the wall thickness of fluid flow tubes 93 are noted and a dimension will be chosen that is less than twice the thickness of the fluid flow tubes. The dimension is given the designation symbol t. The radius $r_1$ of arc 64 is already known from the dimensions of the roller cage assemblies. Radius $r_2$ is then calculated by adding twice the dimension t to radius $r_1$ (i.e., $r_2=(2\times t)+r_1$). Radius $r_2$ is then the radius of curvature of pressure platen surface 90 and it has its center on the perpendicular drawn through the center of curvature of arc 64. In this manner the spacing between the arc described by the outer surface of the roller rods and the platen pressure surface gradually decreases from a predetermined maximum to a predetermined minimum and then gradually increases back to a predetermined maximum.

Figure 6:
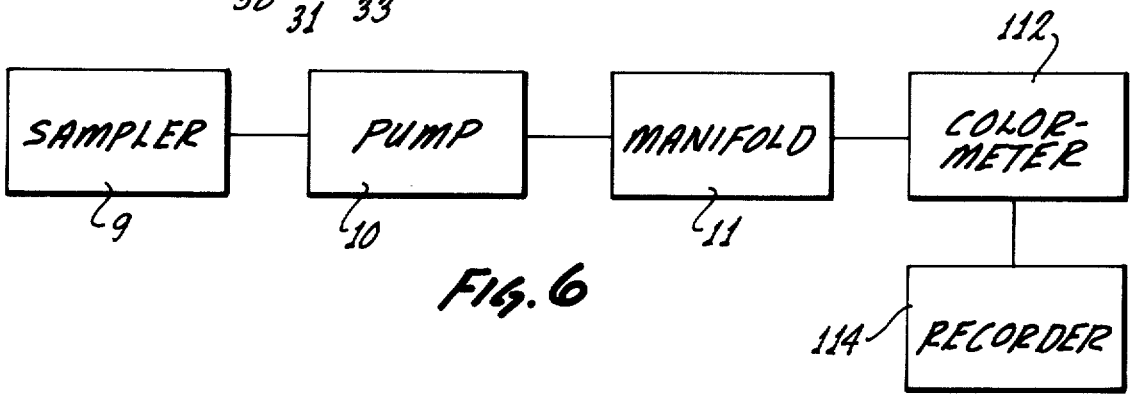
FIG. 6 is a block diagram illustrating the relationship of the proportioning pump to the other components of an automatic fluid analysis apparatus.

In FIG. 6 the sequence of operations performed by the automatic fluid analysis apparatus is described in block diagram. A sampler 9 takes a fluid sample that is then transmitted by pump 10 to a mixing manifold 11 where reagents are mixed with the liquid sample. Next the sample is transferred to the colorimeter 112 where spectral analysis is made by light passing through the fluid sample and making a reading on a photo cell member. The results of this analysis are then made permanent by a recorder 114.

What is claimed is:

1. A proportioning pump comprising:

a base;

a shaft having an x-axis and means for supporting it on said base;

at least one roller cage assembly mounted on said shaft;

said roller cage assembly comprising a pair of laterally spaced and aligned plates each having a primary bore centered on said x-axis and through which passes said shaft, spaced a predetermined radius from the longitudinal axis of said primary bores are a plurality of secondary bores whose longitudinal axes describe circles in said laterally spaced plates, roller rods are journaled in said secondary bores;

elastic tubing adapted to be peristaltically compressed by said roller rods;

the outer perimeter of each of said roller rods describes an arc of a predetermined radius $r_1$ from the x-axis of said primary bore when said roller cage assembly is rotated about its longitudinal axis; and a platen pressure surface having a concave transverse curvature of a predetermined radius $r_2$, said radius $r_2$ being greater than $r_1$ and having its center positioned below said x-axis on a perpendicular line passing vertically through said x-axis whereby the spacing between the arc described by the outer surface of said roller rods and said pressure surface gradually decreases from a predetermined maximum to a predetermined minimum and then gradually increases back to a predetermined maximum.

2. A proportioning pump as recited in claim 1 wherein said base has an open chamber formed in its top by a bottom wall portion and at least two laterally spaced upstanding walls, said shaft being supported in said open chamber.

3. A proportioning pump as recited in claim 2 wherein said platen pressure surface is on the bottom of a platen member that closes the top of said open chamber.

4. A proportioning pump as recited in claim 3 wherein said platen member has a plurality of roller cage assembly end plate recesses formed in its platen pressure surface.

5. A proportioning pump as recited in claim 2 wherein said means for supporting said shaft comprises a pair of laterally spaced mounting plates located adjacent the opposite ends of said shaft that have bearings in their bores to allow said shaft to rotate while said mounting plates remain stationary.

6. A proportioning pump as recited in claim 2 wherein said laterally spaced upstanding walls have means along their top surface for spacing and positioning flexible fluid flow tubes that pass through said proportioning pump between said roller cage assembly and said platen pressure surface.

7. A proportioning pump as recited in claim 1 further comprising means for making the roller cage assembly rotate when said shaft is rotated.

8. A proportioning pump as recited in claim 7 wherein said means for making said roller cage assembly rotate when said shaft is rotated comprises a pin passing through aligned transverse bores in said shaft and one of said plates of said roller cage assembly.

9. A proportioning pump as recited in claim 1 further comprising at least one idler pressure wheel journaled on said shaft within the interior of said roller cage assembly with the outer lateral surface of said idler pressure wheel being in substantial surface contact with the interior lateral surface of said roller rods.

10. A proportioning pump as recited in claim 1 wherein there are at least two roller cage assemblies on said shaft and there is an intermediate mounting plate on said shaft between said roller cage assemblies, said shaft being journaled in an axial bore of said intermediate mounting plate.

* * * * *